US006133719A

United States Patent [19]

Maulik

[11] Patent Number: 6,133,719

[45] Date of Patent: Oct. 17, 2000

[54] ROBUST START-UP CIRCUIT FOR CMOS BANDGAP REFERENCE

[75] Inventor: Prabir C. Maulik, Austin, Tex.

[73] Assignee: Cirrus Logic, Inc., Austin, Tex.

[21] Appl. No.: 09/418,072

[22] Filed: Oct. 14, 1999

[51] Int. Cl.[7] ..... G05F 3/16; G05F 3/20

[52] U.S. Cl. ..... 323/313; 323/901; 323/316

[58] Field of Search ..... 323/313, 314, 323/315, 316, 907, 901

[56] References Cited

U.S. PATENT DOCUMENTS

| | | | |
|---|---|---|---|
| Re. 35,951 | 10/1998 | Ganesan et al. | 323/313 |
| 3,588,535 | 6/1971 | Hellstrom | 323/313 |
| 4,250,445 | 2/1981 | Brokaw | 323/313 |
| 4,590,418 | 5/1986 | Moriarty, Jr. | 323/313 |
| 4,595,874 | 6/1986 | Hein et al. | 323/312 |
| 4,714,872 | 12/1987 | Traa | 323/314 |
| 4,857,823 | 8/1989 | Bitting . | |
| 5,087,830 | 2/1992 | Cave et al. . | |
| 5,126,653 | 6/1992 | Ganesan et al. | 323/314 |
| 5,352,973 | 10/1994 | Audy | 323/313 |
| 5,448,158 | 9/1995 | Ryat | 323/315 |
| 5,604,427 | 2/1997 | Kimura | 323/313 |
| 5,867,013 | 2/1999 | Yu | 323/314 |
| 5,910,726 | 6/1999 | Koifman et al. | 323/315 |

OTHER PUBLICATIONS

Bang–Sup Song and Paul R. Gray, "A Precision Curvature–Compensated CMOS Bandgap Reference", IEEE J. Solid State Circuits, vol. SC–18, No. 6, pp. 634–643, Dec. 1983.

John Michejda and Suk K. Kim, "A Precision CMOS Bandgap Reference". IEEE J. Solid–State Circuits, vol. SC–19, No. 6, pp. 1014–1021, Dec. 1984.

*Primary Examiner*—Peter S. Wong
*Assistant Examiner*—Bao Q. Vu
*Attorney, Agent, or Firm*—J. P. Violette; Peter Rutkowski; William W. Kidd

[57] ABSTRACT

A technique for providing a start-up circuit for a bandgap reference. An amplifier configured in a differential arrangement as the bandgap reference. A start-up circuitry ensures that a second input node is maintained at a lower voltage than a first input node of the amplifier at start-up, when the output node corresponding to the second input side of the amplifier is also pulled low.

20 Claims, 2 Drawing Sheets

ROBUST START-UP CIRCUIT FOR CMOS BANDGAP REFERENCE

BACKGROUND OF THE INVENTION

1. Field of the Invention

The present invention relates to the field of bandgap reference circuits and, more particularly, to start-up techniques for initializing bandgap references.

2. Background of the Related Art

Bandgap reference circuits are utilized to provide precise reference sources. This reference is utilized to generate a reference voltage or current to support other circuitry. One purpose for using the bandgap reference is to provide an accurate and stable output over a temperature range. That is, the bandgap circuit operates with the proper temperature coefficient compensation to correct for variations introduced due to a change in the operating temperature. One area of usage of bandgap references is in the area of analog or mixed signal processing.

A typical bandgap circuit utilizes bipolar transistors to provide the bandgap function. When complementary metal-oxide semiconductor (CMOS) devices are implemented, the bandgap reference generally utilizes parasitic bipolar transistors. The bandgap circuit relies on the difference of the base-emitter junction voltages to provide a linear temperature correction voltage, which is proportional to the absolute temperature (referred to as PTAT). In addition, the base-emitter junction voltage $V_{BE}$ is proportional to the negative coefficient of temperature. That is, the $V_{BE}$ measurement is used to track and correct changes in the circuit, caused by a change in temperature. The combination of these two effects results in the bandgap reference responding with a near zero temperature coefficient. Therefore, sources using the bandgap reference respond with a near-zero temperature coefficient at the output.

In a typical CMOS bandgap circuit, a high-gain feedback loop ensures that a correction signal is generated to compensate for the change in the $V_{BE}$ of the bipolar transistors employed. Generally, the $V_{BE}$ of individual transistors has a negative coefficient of temperature, while the difference of $V_{BE}$ of two transistors has a positive coefficient of temperature. Accordingly, as the temperature changes, the change in the $V_{BE}$ of the transistor(s) in response to the temperature change is sensed to generate a feedback signal to maintain the output of the source relying on the bandgap reference to have substantially constant output (near zero variation of the output).

In order to initialize a bandgap reference (such as at start-up), a start-up circuit is typically utilized. The start-up circuit ensures that the bandgap reference initializes to a desired operating mode, at which time the start-up circuit is disengaged or returned to its idle state. The start-up circuit can be a simple pulse generating circuit, or it can be a circuit which includes components for sensing and turning off the start up signal.

One problem associated with the initializing the bandgap circuit at start-up is in ensuring that the bandgap circuit enters the desired mode of operation. For example, a bandgap circuit could initialize to a zero state where the bipolar transistors are turned-off. Essentially, the zero state is a turned-off state where the circuit is non-operative. Therefore, start-up circuits generally provide some technique to ensure that the start up mode is not the zero-state mode.

In some bandgap reference circuits, there is a possibility that the bandgap circuit may enter into another undesirable mode at start-up. The present invention addresses a concern when some bandgap circuits have a potential of entering into a quasi high-current state, which results in the improper operation of the bandgap reference.

SUMMARY OF THE INVENTION

A start-up circuit for a bandgap reference is described. An amplifier configured in a differential arrangement provides an output which is determined by a difference of first and second input nodes of the amplifier. The output is controlled by a control line coupled to an output node on a path of the differential arrangement corresponding to the second input node. A first bipolar transistor or transistors are coupled to the first input node. A second bipolar transistor or transistors are coupled to the second input node and also to the first transistor. The two sets of bipolar transistors are coupled to each other and the amplifier to operate as a bandgap reference circuit.

A start-up circuitry is then coupled to the second input node for pulling the second input node toward a potential value relative to the first input node to prevent the two bipolar transistors from locking into a high current condition from which they cannot recover. This condition typically occurs at initialization when a start-up signal is placed on the output node.

DETAILED DESCRIPTION OF THE INVENTION

Figure 1:
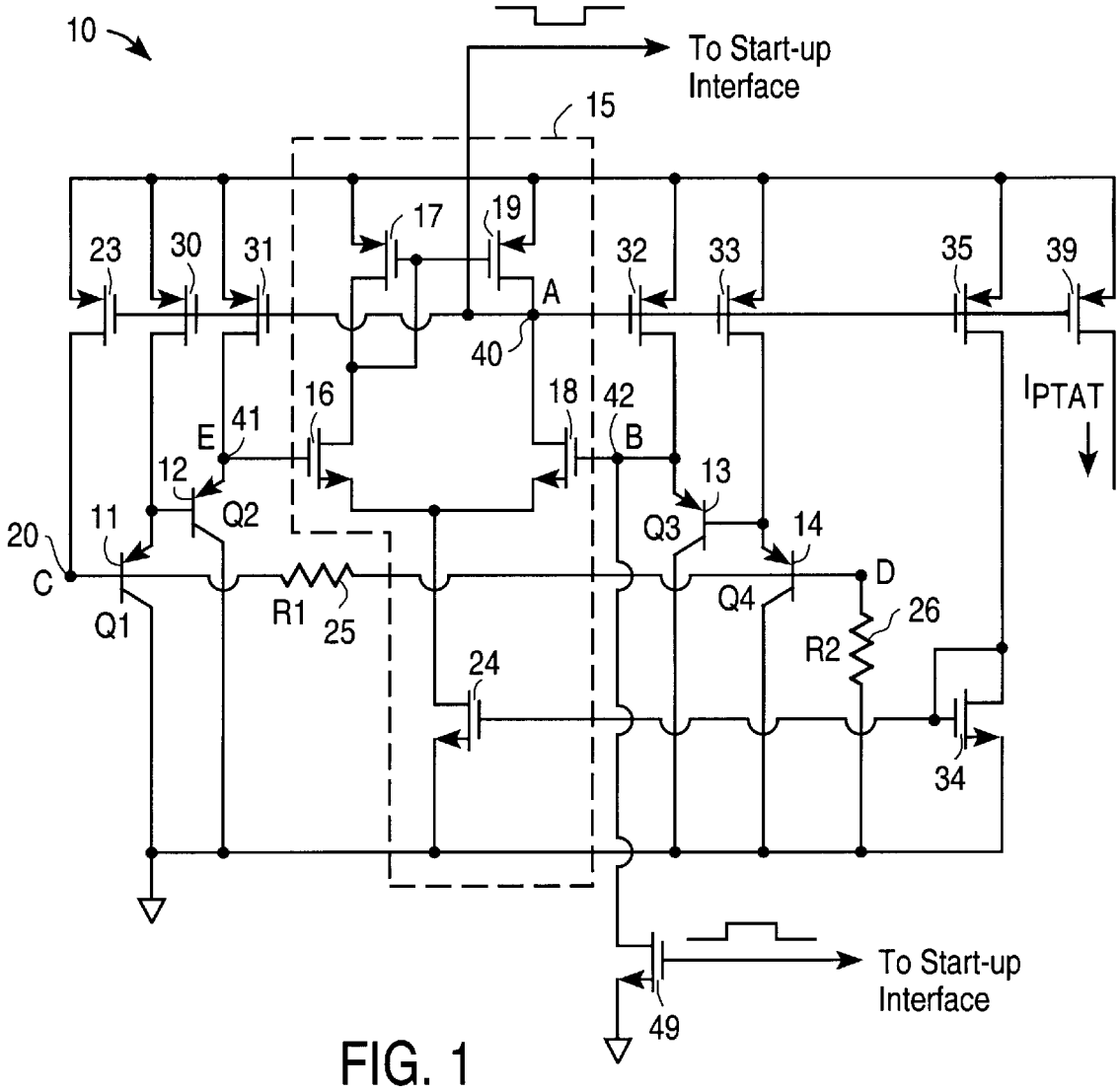
FIG. 1 is a circuit schematic diagram of a bandgap reference in which a start-up circuit of the present invention is utilized.

Referring to FIG. 1, an embodiment of a complementary metal-oxide semiconductor (CMOS) bandgap reference circuit 10 is shown, in which its output is noted as $I_{PTAT}$. The output $I_{PTAT}$ is a current output which provides an error signal corresponding to a change in the temperature of the circuit. The $I_{PTAT}$ output is then fed to an appropriate circuitry to generate a reference, which is independent of temperature (generally to the first order). For example, $I_{PTAT}$ is coupled to provide an error signal to adjust an output from a voltage reference source, so that the voltage reference source has substantially constant output throughout a given temperature range.

It is to be noted that the bandgap circuit 10 can be coupled to a variety of voltage or current generating circuitry, which are typically used to source a reference signal or supply to other circuitry. A variety of such reference sourcing circuits can be coupled to utilize $I_{PTAT}$ for temperature compensation. Thus, the bandgap reference circuit 10 shown generates the signal $I_{PTAT}$ as a temperature compensation signal. This $I_{PTAT}$ current output is then coupled to other circuitry which will then function as a temperature compensated reference source. It is also to be noted that the temperature compensating signal need not be limited to the exact aspect of $I_{PTAT}$.

That is, temperature correction signals can be tapped from other locations of the circuit 10 to provide the compensation signal.

In the particular embodiment of the CMOS bandgap circuit 10, two pairs of bipolar transistors 11, 12 and 13, 14 (also noted as Q1, Q2, Q3 and Q4, respectively) are coupled in a differential arrangement for input into an operational amplifier (op amp) 15. In the example, the transistors Q1–Q4 are parasitic p-n-p transistors. The base of the transistor Q2 is coupled to the emitter of the transistor Q1 and the emitter of the transistor Q2 is coupled to the gate of an n-channel (NMOS) transistor 16. The transistor 16 is part of the CMOS pair, comprised of transistor 16 and a p-channel (PMOS) transistor 17. The transistors 16, 17, along with a common n-channel transistor 24, process one input of the op amp 15.

Likewise transistors Q4 and Q3 are arranged similarly (base of Q3 to the emitter of Q4) and have the emitter of the transistor Q3 coupled to the gate of an n-channel transistor 18. The n-channel transistor 18 and a p-channel transistor 19 form the CMOS pair for processing the other input of the op amp 15, along with the common transistor 24. The collectors of the transistors Q1–Q4 are coupled to ground. Also, a node 20 at the base of the transistor Q1 is designated as node C and a node 21 at the base of the transistor Q4 is designated as node D. The emitters of each of the transistors Q1–Q4 are coupled to a supply voltage Vdd through the p-channel transistors 30, 31, 32, 33, respectively.

Node C is at the base of the transistor Q1 and the p-channel transistor 23 is coupled between Vdd and node C. As can be noted, the transistors Q1–Q4 are configured to operate with corresponding p-channel transistors 30–33. A resistor 25 (also noted as R1) is coupled between node C and node D. A resistor 26 (also noted as R2) is coupled between node D and ground, so that the combination of the two resistors R1, R2 forms a serial path from node C to a supply return, which is ground in this instance.

The n-channel transistor 24 coupled between the sources of transistors 16, 18 and ground is part of the op amp 15. Components of the op amp 15 for this circuit is shown within the dotted line. A CMOS pair of transistors 34, 35 are coupled between Vdd and ground, with the drain of the n-channel transistor 34 coupled to its gate and having its gate also coupled to the gate of the transistor 24. The transistors 24 and 34 operate as a current mirror. The output $I_{PTAT}$ is obtained at the drain of the p-channel transistor 39. The gates of the transistors 23, 30, 31, 32, 33, 35 and 39 are all coupled together and noted as node 40 (also node A). Node A is also coupled to the junction of the CMOS pair of transistors 18, 19 of op amp 15, so that these p-channel transistors 23, 30, 31, 32, 33, 35, 39 have their gates controlled by op amp 15. A node 41 at the input of the op amp 15, coupled to the transistor Q2, is noted as node E. The other input of the op amp 15 coupled to the emitter of the transistor Q3 is noted as node 42 (also node B).

The circuit arrangement described above and shown in FIG. 1 provides a bandgap reference for generating an error correction signal $I_{PTAT}$ at the output of the transistor 39. In designing the circuit 10, transistors 30–33 are matched to have equal or proportionate current flow through transistors Q1–Q4. During normal operation the voltages at nodes B and E are almost equal, because of the high gain of op amp 15. The voltage drop across the resistor R1 is $\Delta V_{BE}$ where $\Delta V_{BE}$ equals $V_{BE4}+V_{BE}-V_{BE2}-V_{BE1}$. Therefore, a current $\Delta V_{BE}$/R1 flows through R1. The output $I_{PTAT}$ is proportional to $\Delta V_{BE}$/R1 by virtue of the gates of the transistors 23, 30–33, 35, 39 being tied together. Also, the voltage at node D is proportional to $\Delta V_{BE}$, because the resistors R1 and R2 are ratioed.

It is to be noted that bandgap circuit 10 of FIG. 1 has the resistor R2. The presence of the resistor R2 raises node D to a potential above ground. This raising of the potential at node D allows the common mode voltage of the op amp 15 to be raised to a reasonable level above ground. Thus, although the technique of the present invention can be implemented in a variety of circuits, the bandgap circuit of FIG. 1 has its common mode raised above ground by the resistor R2.

A problem encountered in the bandgap circuit 10 is in initializing the circuit 10, such as at start up. Generally, for a start-up condition, node A is pulled low so that the p-channel transistors 30–33 conduct. This action then causes the transistors Q1–Q4 to conduct as well. A start-up circuit can be configured to detect the current flow through at least one of the transistors Q1–Q4 to inactivate or terminate the start-up sequence. A zero current (zero state) mode would be noticed since under that mode, no current will flow through the transistors Q1–Q4. However, such a start-up circuit would not detect a high current, which exists under a quasi-high-current state. The quasi high-current state is defined as a mode in which the transistors Q1–Q4 still conduct, but the circuit 10 is not in the proper mode of operation.

The quasi high-current state can occur in the circuit 10 when two conditions exist. When node A is pulled low, the p-channel transistors conduct causing transistors Q1–Q4 to be placed into conduction. Node C is pulled very close to the rail (Vdd), and the p-channel transistor 23 operates more in the linear region of operation, instead of in saturation. The current through the resistor R1 is low causing the voltage drop across it to be low. Hence, there is not much potential difference between nodes C and D. If the transistors 32 and 33 conduct more than transistors 30 and 31, the transistors Q3 and Q4 will have a higher $V_{BE}$ drop through them, causing the voltage at node B to be higher than the voltage at node E. The higher conduction of the transistors Q3, Q4 can occur naturally or by design choice if the ratioing of resistors requires that the transistors 32, 33 conduct more current than the transistors 30,31.

In any event, if the voltage at node B rises above the voltage at node E while node A is pulled low, the circuit stays locked in that condition even when node A is no longer being pulled low (such as when a start-up signal is removed). This locked condition results because node A should move towards Vdd after the low condition is removed, but the op amp 15 cannot do so if node B is higher than node E. A dead-lock (lock-up) condition occurs since node A cannot be pulled high towards Vdd if node B is higher than node E and node B will remain higher than node E (since the circuit is not operating properly to adjust for the potential difference), as long as node A is pulled low. The circuit 10 can stay dead-locked in this condition indefinitely. The problem is compounded at lower temperatures, since the circuit 10 is more susceptible to entering into this undesirable quasi high-current state (at lower temperatures $V_{BE}$ will be higher due to the negative coefficient of temperature).

In order to alleviate the circuit from entering into the quasi high-current state, the present invention ensures that node B is maintained at a potential lower than node E when node A is pulled low. By ensuring this voltage relationship between nodes B and E, the transistor 18 will not be turned on fully to cause the bipolar transistors Q3, Q4 to enter the high-current state.

A technique of the present invention is to pull node B low when node A is pulled low. A transistor 49 (an n-channel transistor in this example) is inserted between node B and ground and its gate activated by a signal from a start-up circuit. Therefore, during start-up, both node A and node B are pulled low toward ground. The pulling of node B toward ground ensures that the voltage at node B is less than the voltage at node E. Although the four bipolar transistors are driven into conduction, with node A pulled low, the circuit 10 will recover into its normal mode of operation when the initialization signal is removed from nodes A and B. Thus, the circuit will not lock into the quasi high-current state.

It is appreciated that a variety of circuits can be designed for providing a start up or initialization signal (which is shown as a level-shifted pulse). Generally, start-up circuits will monitor the conduction of the transistor(s) Q1–Q4 and self turn off the start up sequence when conduction is detected. A variety of circuits can be designed or implemented from those known in the prior art.

Figure 2:
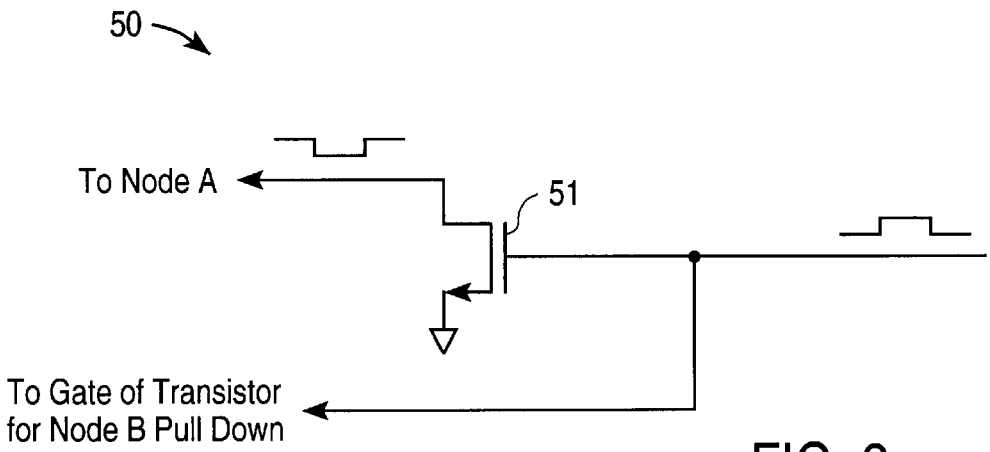
FIG. 2 is a circuit schematic showing one interface to the circuit of FIG. 1 for coupling a start-up signal.

FIG. 2 shows one arrangement in which a level-shifted pulse is provided to both node A and to the gate of the transistor 49. A circuit 50 is comprised of an n-channel transistor 51, which is gated by a level-shifted signal that transitions high when start-up is initiated. The signal is coupled to the gate of the transistor 51 as well as to the gate of the transistor 49 of circuit 10. The transistor 49 is turned on pulling node B low, while the transistor 51 is turned on, pulling node A low. Thus, in this arrangement, circuit 50 activates the transistors 49, 51 to place a low condition on nodes A and B. When the start up sequence is terminated, the transistors 49 and 51 are turned off. The low condition through the transistor 51 to node A is disconnected, so that node A now responds only to the normal operation of the circuit 10.

Figure 3:
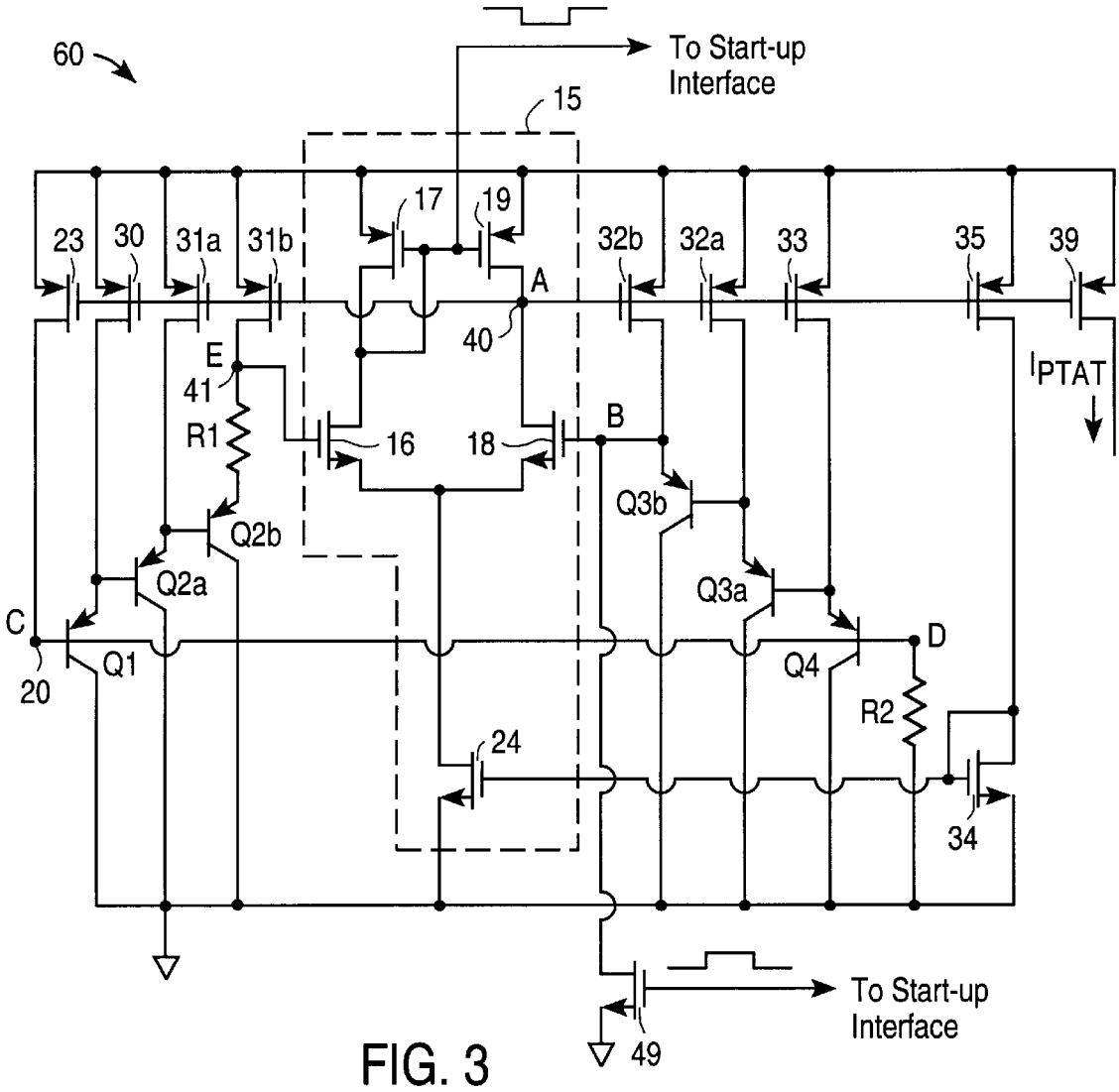
FIG. 3 is a circuit schematic diagram of an alternative bandgap reference circuit in which the start-up circuit of the present invention is also utilized.

It is appreciated that the present invention can be implemented in other circuitry as well and is not limited to the circuit 10 of FIG. 1. Thus, another bandgap reference circuit 60 is shown in FIG. 3. In FIG. 3 the circuit configuration, including the op amp 15 configuration, is the same as circuit 10, except for the addition of another p-n-p bipolar transistor in each leg and the location of R1.

In the circuit 60, one leg (or branch) is comprised of the transistors Q1, Q2A and Q2B (thus, three bipolar transistors are employed in the branch) and the other leg is comprised of the transistors Q3A, Q3B and Q4. It can be shown that the current through the resistor R1 is $\Delta V_{BE}/R1$, where $$\Delta V_{BE}=V_{BE4}+V_{BE3A}-V_{BE3B}-V_{BE1}-V_{BE2A}-V_{BE2B}$$

Accordingly, circuits 10 and 60 operate equivalently and the same quasi high-current condition could exist if similar conditions exist at nodes B and E during start up.

An equivalent technique can be used to ensure that node B is maintained at a lower potential than node E when node A is pulled low, so that the circuit can enter the proper operating mode when the start-up signal is removed. In the shown embodiment, the transistor 49 is utilized on node B to ensure that the circuit recovers to the proper operating mode at start up.

Figure 4:
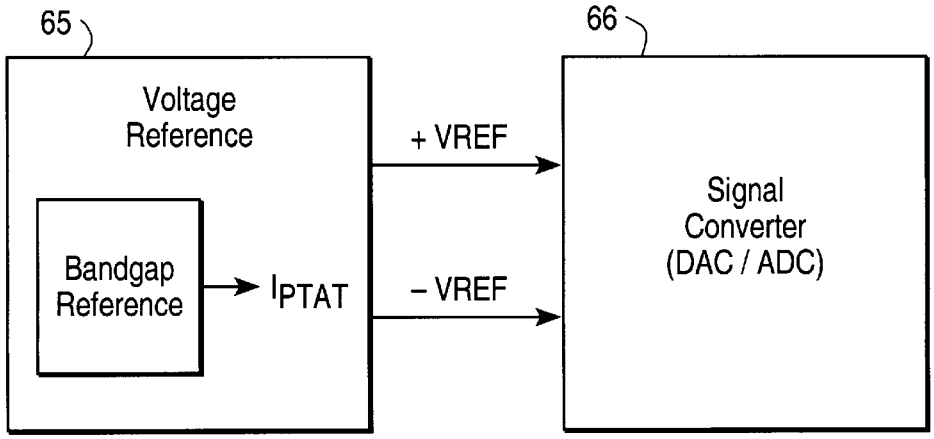
FIG. 4 is a block diagram showing an application of the bandgap reference circuit implementing the present invention in which the bandgap reference is used to provide a voltage reference to a mixed signal converter.

Thus, a robust start-up circuit for a CMOS bandgap reference is described. The invention can be implemented in a variety of bandgap reference circuits. One example is illustrated in FIG. 4. In FIG. 4, the bandgap circuit utilizing the present invention is implemented in a voltage reference source 65. The voltage reference source 65 provides a reference voltage to a mixed signal device, such as a signal converter 66. In the example, the converter is either an analog-to-digital converter (DAC) or a digital-to-analog converter (ADC). These converters can be of an over-sampling type, such as those using a delta-sigma modulator. The voltage reference is used to provide a reference when sampling the input for conversion. It is desirable that a precise voltage reference be available, which provides a substantially constant voltage independent of temperature.

Furthermore, although a set of transistors are shown for each side of the differential input, it is to be noted that the circuit can be adapted for a single bipolar transistor on each side. In addition, the example circuits are shown implementing p-n-p bipolar transistors configured with corresponding p-channel transistors. However, n-p-n bipolar transistors and corresponding n-channels transistors can be utilized to implement equivalent circuitry. Accordingly, there are many variations of circuitry available for practicing the present invention.

I claim:

1. A bandgap reference circuit comprising:

an amplifier configured in a differential arrangement to provide an output which is determined by a potential difference of first and second input nodes of said amplifier, the output being controlled by a control line coupled to an output node on a path of the differential arrangement corresponding to the second input node;

a first bipolar transistor coupled to the first input node;

a second bipolar transistor coupled to the second input node and also to said first transistor, said two bipolar transistors coupled to each other and said amplifier to operate as a bandgap reference circuit; and a start-up circuitry coupled to the second input node for pulling the second input node toward a potential value relative to the first input node to prevent said two bipolar transistors from locking into a high current condition from which they cannot recover, when a start-up signal is placed on the output node.

2. The bandgap reference circuit of claim 1 further including a first resistor coupled between said first and second transistors wherein a current flow through said first resistor determines the potential difference between said two input nodes.

3. The bandgap reference circuit of claim 2 further including a second resistor coupled to said first resistor on a side of said amplifier corresponding to the second input node, said second resistor ratioed with said first resistor to shift a common mode of said amplifier.

4. The bandgap reference circuit of claim 1 further including a first resistor coupled between the first input node and said first transistor wherein a current flow through said first resistor determines the potential difference between said two input nodes.

5. The bandgap reference circuit of claim 4 further including a second resistor coupled to the coupling of said two transistors, said second resistor ratioed with said first resistor to shift a common mode of said amplifier.

6. The bandgap reference circuit of claim 1 wherein said start-up circuitry includes a third transistor, which is made to transition when a start-up signal to initialize the bandgap reference circuit is received.

7. The bandgap reference circuit of claim 6 wherein said start-up circuitry further includes a fourth transistor which is made to transition by the start-up signal to force the two bipolar transistors into conduction to initialize the bandgap reference circuit.

8. A complementary metal-oxide semiconductor (CMOS) bandgap reference circuit comprising:

an amplifier configured in a differential arrangement to provide an output which is determined by a potential difference of first and second input nodes of said amplifier, the output being controlled by a control line coupled to an output node on a path of the differential arrangement corresponding to the second input node;

a first set of at least one bipolar transistor coupled to the first input node;

a second set of at least one bipolar transistor coupled to the second input node and also to said first set of transistor, said two sets of transistors coupled to each other and said amplifier to operate as a bandgap reference circuit based on difference values of their base-to-emitter ($V_{BE}$) voltages; and a start-up circuit coupled to the second input node for pulling the second input node toward a potential value relative to the first input node to prevent said two sets of bipolar transistors from locking into a high current condition from which they cannot recover, when a start-up signal is placed on the output node.

9. The CMOS bandgap reference circuit of claim 8 wherein said first bipolar transistor set is comprised of a plurality of bipolar transistors coupled emitter to base with the emitter of a last transistor stage in the first set coupled to the first node; said second bipolar transistor set also comprised of a same plurality of bipolar transistors coupled emitter to base with the emitter of a last transistor stage in the second set coupled to the second node; and the bases of initial bipolar transistor stages of each set of transistors coupled for differential operation.

10. The CMOS bandgap reference circuit of claim 9 further including a first resistor coupled between the bases of the initial transistor stages wherein a current flow through said first resistor determines the potential difference between said two input nodes.

11. The CMOS bandgap reference circuit of claim 10 further including a second resistor coupled to said first resistor at the base of the initial transistor stage on a side of said amplifier corresponding to the second input node, said second resistor ratioed with said first resistor to shift a common mode of said amplifier.

12. The CMOS bandgap reference circuit of claim 11 wherein said bipolar transistors are p-n-p transistors operating with p-channel transistor and the gates of the p-channel transistors are coupled together to the output node.

13. The CMOS bandgap reference circuit of claim 12 wherein said start-up circuitry pulls the second input node to a lower potential than the first input node, while also pulling the output node low, when initializing said bandgap reference circuit.

14. The CMOS bandgap reference circuit of claim 9 further including a first resistor coupled between the first input node and the emitter of the last transistor stage of the first transistor set, wherein a current flow through said first resistor determines the potential difference between said two input nodes.

15. The CMOS bandgap reference circuit of claim 14 further including a second resistor coupled to the base of the initial transistor stage on the second set of bipolar transistors, said second resistor ratioed with said first resistor to shift a common mode of said amplifier.

16. The CMOS bandgap reference circuit of claim 15 wherein said bipolar transistors are p-n-p transistors operating with p-channel transistor and the gates of the p-channel transistors are coupled together to the output node.

17. The CMOS bandgap reference circuit of claim 16 wherein said start-up circuitry pulls the second input node to a lower potential than the first input node, while also pulling the output node low, when initializing said bandgap reference circuit.

18. A method of initializing a bandgap reference circuit at start-up comprising:

providing differential inputs into an amplifier configured in a differential arrangement in which a difference in bipolar transistor junction voltage drops between a first and second input nodes of the amplifier are used to provide a temperature reference signal;

pulling the second input node toward a potential value relative to the first input node to prevent the circuit from locking into a high current condition from which the circuit cannot recover, when a start-up signal is placed at an output node disposed on a side of the differential arrangement corresponding to the second input node.

19. The method of claim 18 wherein the pulling of the second input node places a low condition on the second input node to lower the potential of the second input node to be less than the first input node.

20. The method of claim 19 further including the pulling of the output node to a low when the start-up signal is placed at the output node.

* * * * *

UNITED STATES PATENT AND TRADEMARK OFFICE

CERTIFICATE OF CORRECTION

PATENT NO. : 6,133,719
DATED : October 17, 2000
INVENTOR(S) : Prabir C. Maulik

It is certified that error appears in the above-identified patent and that said Letters Patent is hereby corrected as shown below:

Column 3,
Line 40, "circuit is shown" should read -- circuit are shown --.
Line 64, "$V_{BE4} + V_{BE}-V_{BE2}-V_{BE1}$" should read -- $V_{BE4} + V_{BE3}-V_{BE2}-V_{BE1}$ --.

Column 6,
Line 1, "(DAC)" should read -- (ADC) --.
Line 2, "(ADC)" should read -- (DAC) --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*